US005706642A

United States Patent [19]

Haselwander

[11] Patent Number: 5,706,642

[45] Date of Patent: Jan. 13, 1998

[54] VARIABLE TWIST LEVEL YARN

[76] Inventor: Jack G. Haselwander, 726 Morning Shadows Dr., Chattanooga, Tenn. 37421

[21] Appl. No.: 729,814

[22] Filed: Oct. 8, 1996

[51] Int. Cl.[6] ..... D01H 7/46

[52] U.S. Cl. ..... 57/264

[58] Field of Search ..... 57/264, 75, 58.3, 57/58.49, 293, 204, 205

[56] References Cited

U.S. PATENT DOCUMENTS

| | | | |
|---|---|---|---|
| 3,981,130 | 9/1976 | Aimbinder et al. | 57/58.3 |
| 4,034,544 | 7/1977 | Clarkson | 57/58.3 X |
| 4,266,397 | 5/1981 | Donmez et al. | 57/75 X |
| 4,276,740 | 7/1981 | Chambley et al. | 57/205 |
| 4,329,841 | 5/1982 | Mang | 57/288 |
| 4,375,744 | 3/1983 | Briner et al. | 57/264 X |
| 4,606,181 | 8/1986 | Lappage et al. | 57/58.3 X |
| 4,736,579 | 4/1988 | Stenmans | 57/58.49 X |
| 4,922,703 | 5/1990 | Matsui et al. | 57/264 X |
| 5,060,467 | 10/1991 | Gill et al. | 57/264 X |
| 5,150,566 | 9/1992 | Stenmans | 57/58.3 |
| 5,174,102 | 12/1992 | Matsui et al. | 57/264 |
| 5,237,805 | 8/1993 | Menegatto | 57/264 X |

*Primary Examiner*—Lenard A. Footland
*Assistant Examiner*—Tina R. Taylor
*Attorney, Agent, or Firm*—Alan Ruderman

[57] ABSTRACT

A method and apparatus for twisting two or more strands of yarn together in accordance with a pre-selected and changeable pattern so as to obtain twisted yarn with a selected twist level extending for a selected length of the yarn and other selected twist levels extending for various other lengths of the yarn so that a package of finished yarn has a variable twist pattern which is reproducible and changeable. The yarn twisting apparatus has a drive for rotating a finished package of twisted yarn, a yarn twister for twisting the yarn together, and a drive for the yarn twister. Each drive includes a motor which may be a servo motor or a controllable a.c. motor so that the product package drive and the yarn twisting drive may be controlled to selected speed ratios, and also includes a programmable controller for controlling this ratio and for varying the time that each selected ratio is maintained.

10 Claims, 4 Drawing Sheets

VARIABLE TWIST LEVEL YARN

BACKGROUND OF THE INVENTION

This invention relates to twisting of yarn or threads and more particularly to twisting of at least two separate yarns or thread strands in accordance with selected patterns.

In the art of twisting yarn and thread, hereinafter together referred to yarn twisting, a pre-determined twist level is selected and remains constant for a particular finished yarn. Twist level is defined as the turns of twist or wrap of the yarn or thread about each other for a given segment of length of the twisted yarn or thread. The twisting of yarn comprises twisting at least one strand or ply of yarn together or about another such that there is a pre-determined number of turns of yarn twisted with or wrapped about another yarn. Various twisting techniques are utilized in the art to obtain a twisted multiple ply yarn product. For example, ring twisting wherein strands of yarn pass through a ring and are twisted as the ring rotates about a rotating bobbin on which the yarn is wound; two-for-one twisting wherein two bobbins of yarn are combined within a common can, pass through the center of a rotating yarn twister spindle and out a radial hole; and cabling wherein one or more yarn strands enter the bottom of a rotating twister spindle at the center and exit through a radial hole and enters an eyelet or ring to form a balloon which throws out about a supply bobbin of another yarn with which it is twisted, are three such methods for twisting yarn strands together or one or more yarns twisted about another yarn. In each method it is the general practice to maintain the twist level or number of turns per inch of the yarn constant. Machines that perform these methods include a common drive motor, and the ratio between the yarn speed and the final yarn package speed, which determines the twist level, is obtained by the use of change twist gears. Thus, the twist level of a particular yarn is constant and is monitored to remain constant. In order to change twist level, different change twist gears are utilized, but this can only be done for one twisted yarn at a time, i.e., a single yarn has only one twist level.

It has been found that if the twist level of a given yarn may be varied along its length, products made from such yarn, such as carpet, may have unusual aesthetic styling. In the prior art, an attempt to obtain twist variation along the length of the yarn was proposed in Lloyd U.S. Pat. No. 2,933,881, which utilizes a variable speed device wherein the output speed is controlled by a control lever either moved by a cam or manually moved to change the speed of the yarn take-up spool to vary the twist of the yarn within the final package. It clearly is impracticable to vary the twist manually with such apparatus since reproducible results would not be obtainable. If a cam is used to create the twist level variation, the variation is limited by the shape and size of the cam, and if another pattern of twisting levels is desired, the cam must be changed.

In Yamada et al U.S. Pat. No. 4,569,192 single strand spun yarns wherein the fibers are spun, drafted and twisted, it was proposed to vary the twist and drafting of the strand while the spun yarn strand is being formed in yarn spinning equipment.

However, there is no known proposal of a system for forming a twisted yarn having multiple plies of yarn which eliminates the need for changing gears, cams or other mechanical or manual devices and which permits large twist pattern variations in the product such that the length of the segments of a desired twist level may be varied along with the twist level. Such yarn can be utilized for forming carpet or other textiles with unique and different patterns and aesthetics. Accordingly, it is desirable to provide a system whereby variations in yarn twist level may be selectively made and wherein wide variations may be selected when twisting multiple strands of yarn together into a composite twisted yarn.

SUMMARY OF THE INVENTION

Consequently, it is a primary object of the present invention to provide a method and apparatus for twisting two or more strands of yarn into a twisted yarn while varying the twist level selectively along selected lengths of the yarn.

It is another object of the present invention to provide a method and apparatus for twisting two or more yarn strands together in accordance with a selective twist pattern and for changing the pattern selectively.

It is a further object of the present invention to provide in yarn twisting apparatus a method and apparatus for selectively controlling the ratio of speeds of the yarn producing package and the yarn twisting speed.

Accordingly, the present invention provides a method and apparatus for twisting two or more strands of yarn together in accordance with a pre-selected and changeable pattern so as to obtain twisted yarn with a selective twist level extending for a selective length of the yarn and other selective twist levels extending for various selective lengths of the yarn so that the yarn on a product package or spool has a variable twist pattern, i.e., a selected twist level for a selected segment of the yarn, the twist pattern being reproducible and changeable.

To this end, the present invention provides yarn twisting apparatus having a drive means for rotating a finished package of plural strands of yarn twisted together, a yarn twisting means for twisting the yarns together, and a drive means for the yarn twisting means including controllable drive means for the product package drive and the yarn twisting drive, and a programmable control means for controlling the ratio between the yarn twisting speed and the package speed and also the time that the speed ratios are maintained.

In accordance with the invention various patterns may be stored in a processing device or controller which controls the final pattern of the yarn and can be programmed to make various patterns. Changing from one pattern to another merely involves accessing the pattern from stored information in the processing device.

The drive means for each of the finished package and the yarn twister means comprises a motor controlled by a programmable controller which drives the respective motor at precise speeds for precise times to change the speed ratios in accordance with the pattern.

The principles of the present invention may be applied to any of the known yarn twisting methods. For example, it may be applied readily to the cabling method, the two for one twisting or ring twisting methods merely by utilizing a motor which may have its speed controlled for driving at least the product package or the yarn twisting means, or both. A controller with a tachometer feed-back may control the speed of at least one of the motors relative to the other to a selected twist ratio for selected times. In this manner the twist level may be selected for selected lengths of the finished yarn in accordance with a pattern stored within the controller.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
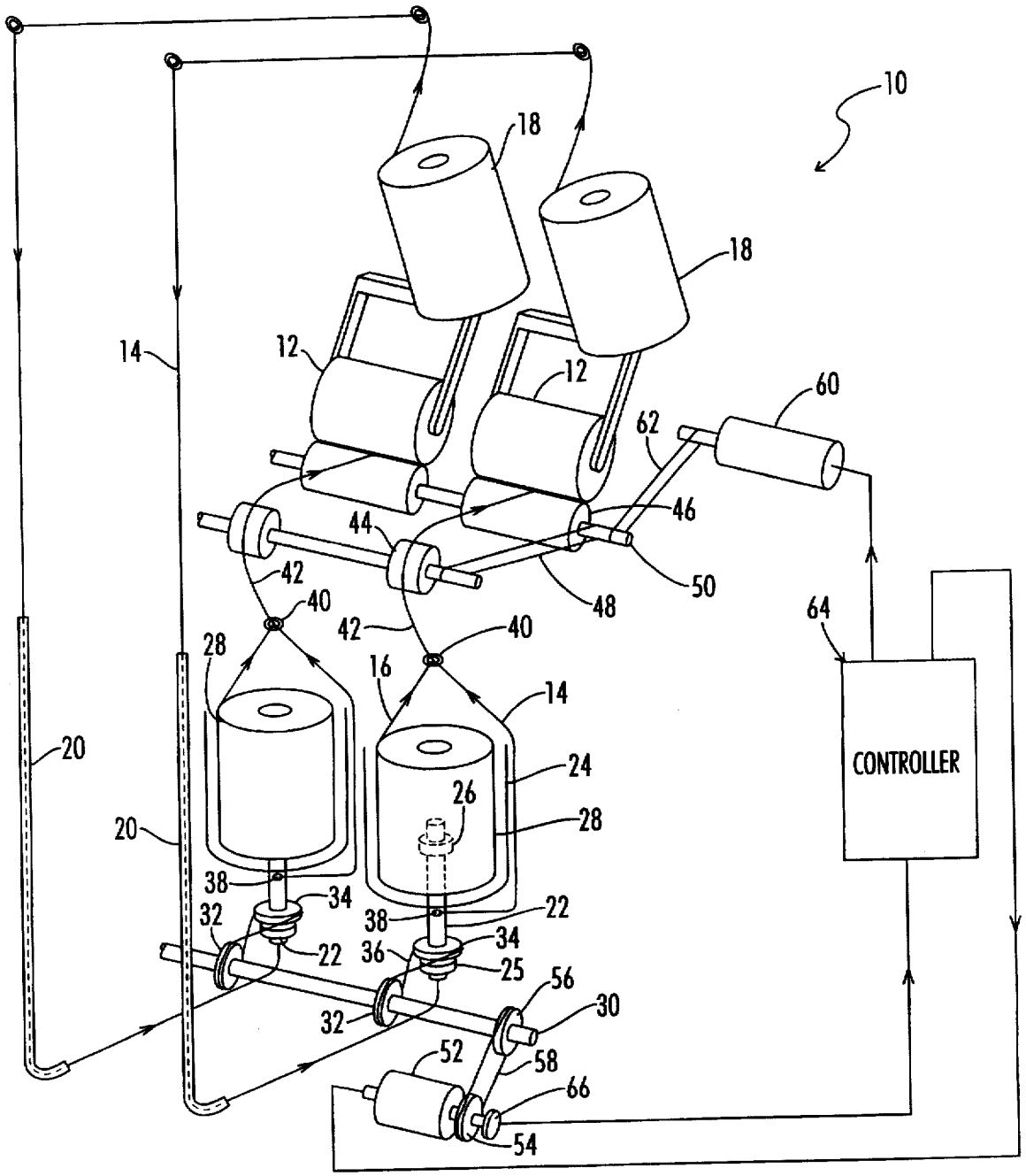
FIG. 1 is a diagrammatic view illustrating apparatus for the cabling method of twisting two yarn strands together into a twisted yarn product and having patterning apparatus constructed in accordance with the principles of the present invention.

Referring now to the drawings, FIG. 1 illustrates a multiple yarn package cabling type twisting system 10 for twisting two yarns into product packages 12 of twisted yarn. Although only two stations of packages 12 are illustrated, it should be understood that a yarn twisting facility may have many such stations being formed simultaneously, one hundred such stations not being uncommon. Additionally, although FIG. 1 illustrates the twisting of two yarn strands 14, 16, which is the usual situation, three or more such yarns may be twisted together at one station by a single twister without departing from the present invention. One of the strands 14 is drawn from a supply package 18 conventionally mounted overhead on a creel (not illustrated) and is fed through a guide tube 20 into a bore at the lower end of the spindle 22 rotating within a bearing 25 which extends into a can or bucket 24. A bearing assembly 26 adjacent the upper end of the spindle 22 within the can supports the core of a second supply yarn package 28 to prevent rotation of the package 28. Rotation of all the spindles 22 at the multiplicity of stations is derived from a drive shaft 30 on which a pulley 32 corresponding to each spindle 22 and package 28 is mounted. A pulley 34 having an associated clutch (not illustrated) corresponding to each pulley 32 is mounted on a respective spindle 22 and is driven by a belt 36 trained about the pulleys 32, 34 when the clutch is engaged. The clutch may be disengaged to uncouple the respective spindle 22 to the drive shaft 30 for changing the package from one of twisters without shutting down the other twisters.

The yarn strand 14 entering the bore at each spindle 22 exits the bore through a hole 38 disposed in the surface of the spindle, balloons out about the can 24 and is drawn up through a pigtail or ring 40 above the package 28 where it is twisted together with the yarn strand 16 drawn off from the package 28 to form the twisted composite yarn 42. The twisted yarn 42 is then fed to the respective product package 12 by means of a yarn pre-feed roll 44 and a package take-up roll 46 which conventionally engages and drives the package 12, the pre-feed roll being driven by a drive connection 48 from the shaft 50 of the package take-up roll 46.

The number of turns or twist of yarn per minute is derived from the speed of the spindle 22, or yarn twist speed, and thus the drive shaft 30, while the turn per inch of yarn or twist level in the yarn package is derived from the differential or ratio between the speed of the drive shaft 30 and the speed of the yarn package, i.e., the speed of the take-up roll 46. Conventionally, the ratio of these speeds is fixed—a motor and drive coupling drives the shaft 30 and the ratio between the yarn speed and the final package take-up speeds are determined and fixed by use of gearing. However, in accordance with the present invention a main motor 52 drives the shaft 30 via pulleys 54, 56 mounted on the motor 52 and the shaft 30 respectively with a belt or the like 58 trained about the pulleys, the motor 52 acting as a master as hereinafter explained. A separate motor 60 is utilized to drive one or more of the package take-up rolls 46 through coupling means 62, the motor 60 acting as a slave motor as hereinafter explained. If desired, and may be a requirement when tension is critical between the pre-feed rolls 44 and package take-up roll 46, a separate motor (not illustrated), which is also a slave motor, may drive the pre-feed rollers 44. The motors are connected to a programmable controller 64 for controlling the speed of the motor 60 and a pre-feed roll motor if used, in response to a pattern programmed into the controller and in response to the speed of the main motor 52 so as to set the twist level. The main motor includes a tachometer 66 for providing feed-back information to the controller 64.

The motors 52 and 60 may be servo motors or may be a.c. motors, and the controller, which is a conventional microprocessor based programmable industrial controller, is selected to be compatible. The pattern setting means for the controller comprises information as to the speed ratio between the main shaft 52 and the package take-up roller motor 60 and the time this ratio is to be held. The pattern may be as long as desirable with as many segments of different twist levels as desired and practicable within the limits of the controller selected.

Figure 4:
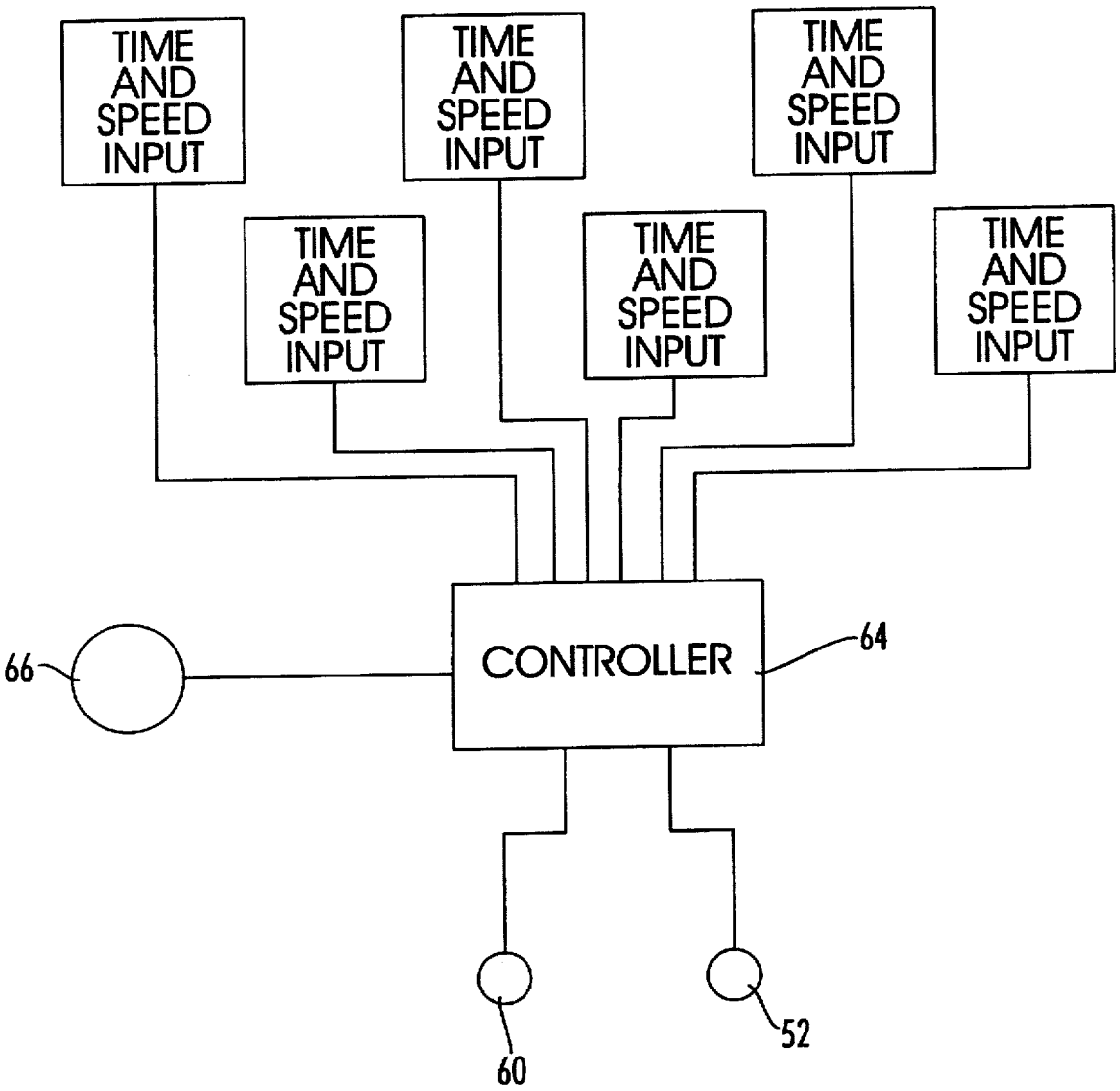
FIG. 4 is an electrical flow diagram for the control of the motors for the yarn twisting apparatus of the present invention.

As illustrated in FIG. 4 with regard to a pattern having six twist segments, the controller 64 receives a programmed input of the speed at which each motor must run for a given period of time for each segment of the pattern. The number of segments of twist in the yarn before a repeat of the pattern is, of course, the length of the pattern. This information is then directed by the controller to the respective output channel of the controller. Thus, at any particular time in the pattern the motors 52, 60 will be rotating at a selected speed and will do so for the required time. The feed-back signals from the tachometer 66 to the controller insures that the motor 60 is operating relative to the motor 52 to provide the required ratio and thus the twist level called for by the pattern.

Where the motors 52, 60 are servo motors, which is the preferred embodiment of the invention, the controller 64 may be a conventional microprocessor-based programmable industrial controller such as those marketed by Giddings & Lewis of Fond du Lac, Wis., U.S. A. under the trademark PiC900. This controller provides motion control of servo motors and drives in a simple manner such that it is readily usable with the twisting system of the present invention. A RAM (random access memory) disk stores data for the pattern selection. At each instant of the pattern the controller instructs each servo motor drive to drive the servo motor at a selected speed in accordance with the twist level called for by the pattern. Thus, the spindle 22 rotates at the required speed and so does the take-up roll 46.

The information input to the controller 64 is dependent upon information calculated to determine the speed and time at that speed based on the pattern. These calculations are based on the desired turns of twist per inch in the pattern and the length of the twist segment in inches. The run time in seconds is directly related to a multiple of these two values divided by the rotation speed of the spindle 22. If the spindle speed, and thus the speed of the motor 52, is constant, which appears to be desirable, the run time for each segment is directly proportional to the twist or turns per inch multiplied by the length of the segment in inches. These values are then utilized by the controller to drive the motor 60 so that the speed of the package take-up roll 46 corresponds to the required speed for the twist level called for. Mathematically if T is the time in seconds, A is the number of turns of twist per inch desired, B is the length in inches of the twist segment and C is the rotational speed of the spindle 22 in revolutions per minute, then T=60BA÷C.

The pattern may, for example, begin with 33 inches of a 1.5 turns of twist per inch, 37 inches of two turns per inch twist, 41 inches of 2.5 turns per inch of twist, 29 inches of four turns per inch of twist, five inches of 6.5 turns of twist per inch, etc. The speed of the motors is then selected or calculated and the run time determined so as to provide these values, and the controller drives the motors for the selected times accordingly. Should it be desired to use controllable a.c. motors rather than servo motors, a programmable controller such as those sold under the trademark PROSEC T1 such as the T1-28 distributed by Toshiba Corporation, Industrial Division located in Houston, Tex., may be selected as the controller 64.

Thus, the output of the controller 64, utilizing the programmed information and the feedback from the tachometer 66, controls the speed of the motors 52, 60 to the desired speed ratio for the programmed twist level for the appropriate time programmed into the controller. A finished twisted yarn is thus wound upon the product package rolls 18 having the desired variability.

Thus, a twisting system of the cabling type having programmable yarn twist levels in accordance with the present invention has been disclosed. The invention may also be applied to a two-for-one twisting system as illustrated in FIG. 2 or a ring twisting system as illustrated in FIG. 3.

Figure 2:
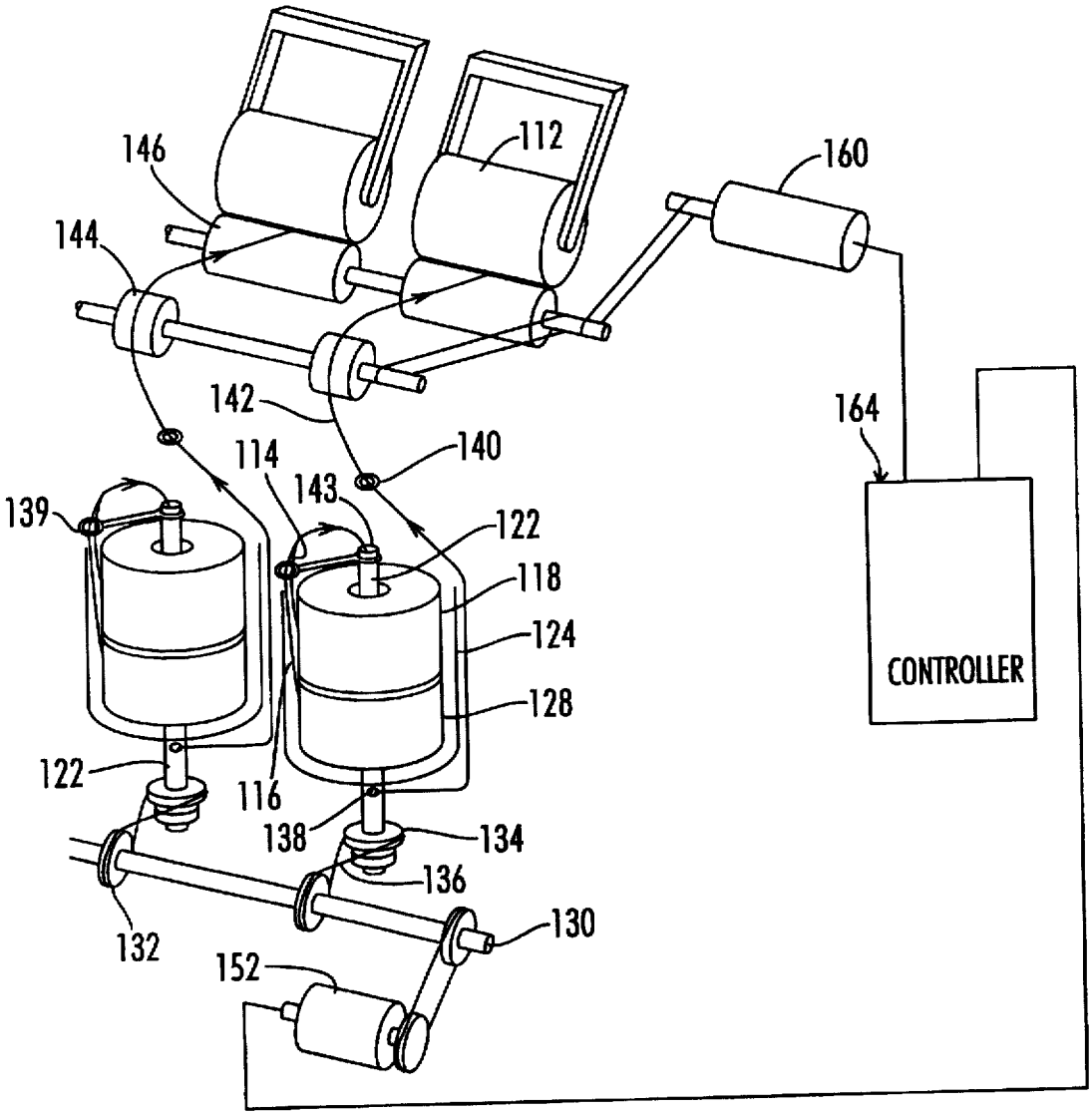
FIG. 2 is a view similar to FIG. 1 but for the two-for-one method of twisting incorporating the present invention.

In a two-for-one twister, as illustrated in FIG. 2, the two supply yarn packages 118, 128 are both mounted within a can or bucket 124, the yarns 114, 116 from the respective supply packages 118, 128 both entering a rotating ring 139 secured to the spindle 122. The two yarns are then directed to a bore 143 in the spindle and exit as twisted yarn 142 through the hole 138 in the surface of the spindle and balloons out about the bucket 124. The twisted yarn is directed through a pigtail or ring 140 above the yarn package and directed to the pre-feed rolls 144 and then to the package take-up rolls 146 which drive the product packages 112. The main motor 152, which is identical to the motor 52, drives the drive shaft 130 which carries pulleys 132 and in turn drives pulleys 134 via belts 136 and thereby drives the spindles 122, the spindles rotating within bearings similar to that in the cable system illustrated in FIG. 1. Moreover, a motor 160 equivalent to the motor 60 of the cable twisting system drives the rolls 46 in a similar manner as in the cable system. In accordance with the present system, the controller 164, which is substantially equivalent to the controller 64, drives the motors 152, 160 in the same manner as the controller 64 in the first embodiment to provide variable twist level yarn on the package 112 in accordance with the program information illustrated in FIG. 4.

Figure 3:
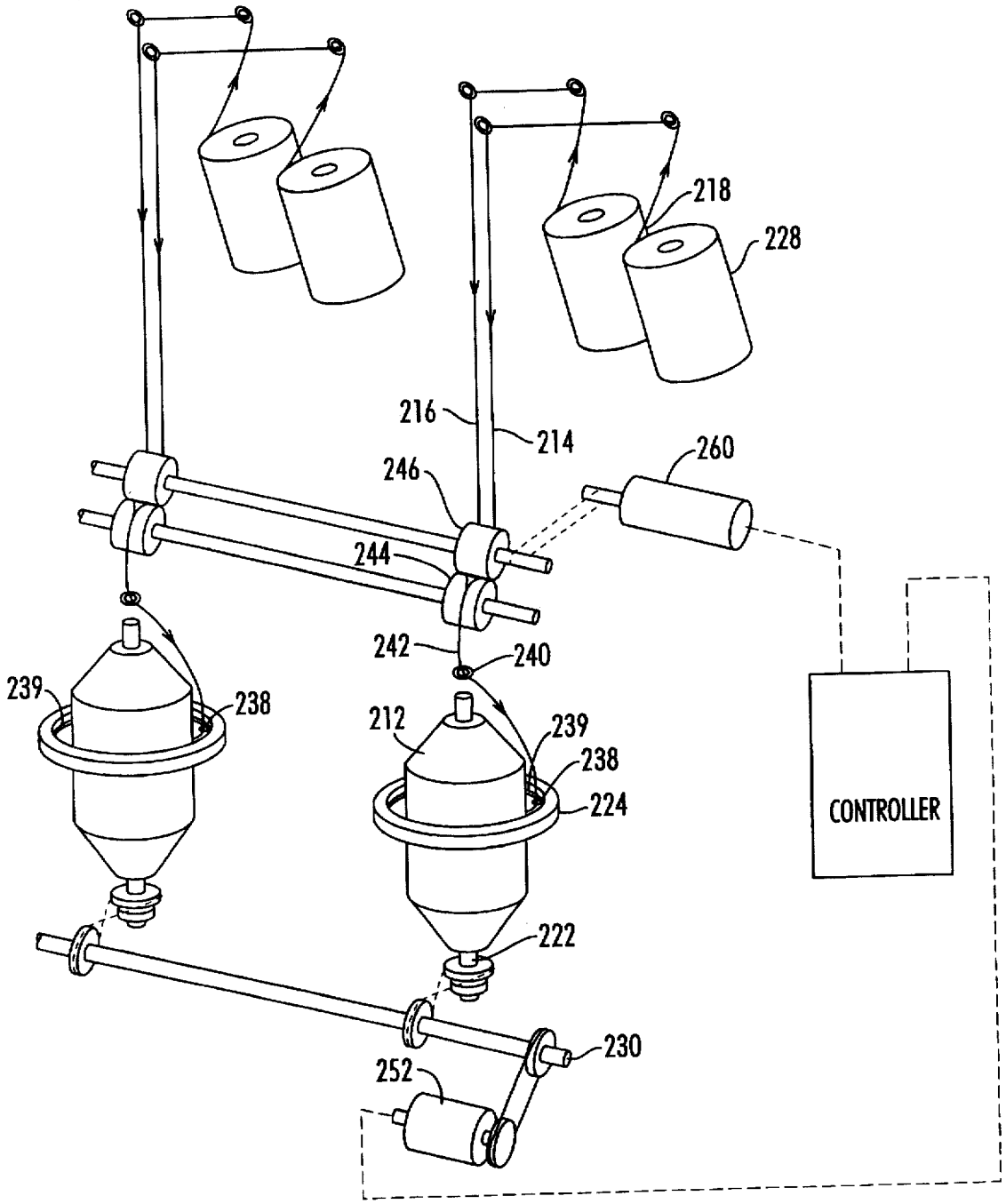
FIG. 3 is a view similar to FIG. 1 but for the ring twisting method of twisting two yarns together incorporating the present invention.

In a ring twister, as illustrated in FIG. 3, both supply packages 218, 228 are mounted on a creel or the like and the two yarns 214, 216 are fed together by feed rolls 244, 246, the rolls being driven by a motor 260 in the same manner as in the other embodiments, the motor 260 being substantially identical to the motor 60. The yarn 242 leaving the nip between the rolls 244, 246 are directed through an eyelet or ring 240 to a traverse ring 238 which is disposed within a slot 239 in a fixed annular ring 224, the traverse ring 238 being constrained by but movable within the slot. The main motor 252, which is substantially identical to the motor 52, rotatably drives the drive shaft 230 in the same manner as in the first and second embodiments and the drive shaft 230 rotatably drives a spindle 222, again in the same manner as in the first and second embodiment. In this case, however, the core of the product yarn package or bobbin 212 is rotatably fastened to the spindle 222. The traverse ring 238 rotates or traverses about the yarn package or bobbin as constrained by the slot 239 within which it is mounted due to the pulling action of the rotating bobbin. This results in the two yarns 214, 216 being twisted together and the speed of the yarn being fed to the ring 238 effects the number of twists per unit of length of the yarn 242. Accordingly, by controlling the speed ratio between the feed rolls 244, 246 by means of the motor 260, relative to the spindle 222 which, of course, is dependent upon the speed of the motor 252, the twist level may be varied in accordance with the pattern input into the controller 264, the latter being substantially identical to the controller 264 and 164 in the other embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for twisting at least two yarn strands together into a finished twisted yarn product having a twist level selectively varied along the length of the yarn in accordance with a preselected pattern, said method comprising providing a supply of said yarn strands, providing a twister having a rotatable spindle and rotatable feed roll means, storing in a progammable controller time and speed data corresponding to said pattern, rotating said feed roll means to feed yarn between said twister, said supply of yarn strands and a package of said finished twisted yarn, controllably rotatably driving each of said spindle and said roll means at first selected speeds corresponding to data stored in said controller to provide a first selected speed ratio, maintaining said first speed ratio for a selected period of time corresponding to data stored in said controller to provide a first twist level of yarn for a first length of finished twisted yarn product, rotatably driving at least one of said spindle and said roll means at a second selected speed corresponding to data stored in said controller to provide a second selected speed ratio, and maintaining said second speed ratio for a selected second period of time corresponding to data stored in said controller to provide a second twist level of yarn for a second length of finished twisted yarn product, said first and second speed and said first and second period of time being selectively varied automatically in accordance with said data stored in said controller to provide multiple twist levels for selectively variable time periods.

2. The method as recited in claim 1, wherein said rotating said roll means feeds yarn from said supply to said twister and then to said roll means and thereafter to said package of finished yarn.

3. The method as recited in claim 1, wherein said feeding said yarn by rotating said roll means comprises feeding said yarn to said twister and to said package of finished twisted yarn.

4. Apparatus for twisting at least two yarn strands together into a finished twisted yarn at each of a multiplicity of stations, the finished yarn at each station having a twist level selectively varied for selective lengths of said finished yarn in accordance with a preselected pattern, said apparatus comprising a first spool of supply yarn and at least a second spool of supply yarn, a spindle rotatable about an axis at each station, each station including means for mounting at least one of said spools of supply yarn about the respective spindle without rotating therewith, first drive means including a first drive motor for rotatably driving all said spindles at a speed related to the rotational speed of said drive motor, at least a portion of each spindle having an axially extending bore and an aperture spaced radially from said axis and opening into said bore, said aperture receiving at least one strand of a respective said at least two yarn strands from said bore, said aperture permitting said strand to exit out of said bore and balloon outwardly about said at least one of said spools of supply yarn to be twisted together with another of said at least two yarn strands, yarn feed roll means at each station for feeding said at least two yarn strands at the respective station to a respective finished yarn package, second drive means including a second drive motor for rotatably driving said yarn feed roll means at least at one of said stations, control means for selectively rotating said first and second drive motors at selected speeds for a selected first time period to provide a selected speed ratio of said speeds and thereby a first twist level for said first time period and thereafter drive at least one of said drive motors at another speed for a second selected time period to provide a second twist level for said second time period in accordance with said pattern, and progammable control means for selectively varying the selected speeds and time periods in accordance with said pattern.

5. Apparatus as recited in claim 4, wherein there is one spool of supply yarn disposed about said spindle, and means for mounting at least another spool of supply yarn remote from said spindle, yarn from said at least one other spool being received into said bore and exiting through said aperture, and means including a ring for combining and twisting yarn from said one spool and yarn from said at least another spool together at a rate dependent upon the speed of said spindle and the speed of said yarn feed roll.

6. Apparatus as recited in claim 5, wherein said drive motors are servo motors.

7. Apparatus as recited in claim 4, wherein there are two spools of supply yarn disposed about each spools, yarn from said two spindles being received into said bore and exiting through said aperture, and means including a ring for combining and twisting yarn exiting through said aperture together at a rate dependent upon the speed of said spindle and the speed of said yarn feed roll.

8. Apparatus as recited in claim 7, wherein said drive motors are servo motors.

9. Apparatus for twisting at least two yarn strands together into a finished twisted yarn at each of a multiplicity of stations, the finished yarn at each station having a twist level selectively varied for selective lengths of said finished yarn in accordance with a preselected pattern, said apparatus comprising a rotatable spindle at each station, means at each station for mounting a finished yarn receiving bobbin on the respective spindle for rotation therewith, first drive means including a first drive motor for rotatably driving all said spindles at a speed related to the rotational speed of said drive motor, a traverse ring disposed about said spindle and moveable concentrically relative to said spindle and a bobbin mounted thereon, yarn feed roll means at each station for feeding at least two yarn strands from a supply and directing said strands to and through said traverse ring and onto said bobbin, second drive means including a second drive motor for rotatably driving all said yarn feed roll means, control means for selectively rotating said first and second drive motors at selected speeds for a first selected time period to provide a selected speed ratio of said speeds and thereby a first twist level for said first time period and thereafter drive at least one of said drive motors at another speed for a second selected time period to provide a second twist level for said second time period in accordance with said preselected pattern and, progammable control means for selectively varying the selected speeds and time periods in accordance with said pattern.

10. Apparatus as recited in claim 9, wherein said drive motors are servo motors.

* * * * *